United States Patent [19]

Naka et al.

[11] 4,251,229

[45] Feb. 17, 1981

[54] STABILIZED FUEL SLURRY

[75] Inventors: Akihiro Naka, Joyo; Shuichi Honjo, Kyoto; Kaoru Aoike, Niigata, all of Japan

[73] Assignee: Dai-Ichi Kogyo Seiyaku Co., Ltd., Kyoto, Japan

[21] Appl. No.: 946,726

[22] Filed: Sep. 28, 1978

[30] Foreign Application Priority Data

| | | | |
|---|---|---|---|
| Oct. 3, 1977 | [JP] | Japan | 52-119230 |
| Oct. 3, 1977 | [JP] | Japan | 52-119231 |
| Oct. 4, 1977 | [JP] | Japan | 52-119663 |
| Oct. 4, 1977 | [JP] | Japan | 52-119664 |
| Oct. 5, 1977 | [JP] | Japan | 52-120216 |
| Feb. 21, 1978 | [JP] | Japan | 53-19265 |

[51] Int. Cl.[3] ..... C10L 1/18

[52] U.S. Cl. ..... 44/51; 44/70; 44/71; 44/77; 44/78; 252/352; 252/356; 252/357

[58] Field of Search ..... 44/51, 70, 71, 77, 78; 252/352, 356, 357

[56] References Cited

U.S. PATENT DOCUMENTS

| | | | |
|---|---|---|---|
| 3,454,646 | 7/1969 | Patton, Jr. et al. | 252/357 |
| 3,668,129 | 6/1972 | Willett | 252/357 |
| 3,729,420 | 4/1973 | Sanders et al. | 252/357 |
| 3,839,413 | 10/1974 | Wolff et al. | 252/357 |
| 4,046,521 | 9/1977 | Bessler et al. | 44/78 |
| 4,083,698 | 4/1978 | Wenzel et al. | 44/51 |
| 4,090,853 | 5/1978 | Clayfield et al. | 44/51 |
| 4,125,382 | 11/1978 | O'Brien et al. | 44/51 |

*Primary Examiner*—Jacqueline V. Howard

*Attorney, Agent, or Firm*—Haight, Rosfeld, Noble & Santa Maria

[57] ABSTRACT

A fuel slurry comprising a mixture of a fuel oil and pulverized coal may be effectively stabilized with a small amount of adducts of alkylene oxide and an alcohol, an amine, a carboxylic acid or a phenol, or inorganic acid esters of said adducts; or cross-linked products of said adducts or said inorganic acid esters.

18 Claims, No Drawings

STABILIZED FUEL SLURRY

This invention relates to a stabilized fuel slurry composition comprising a fuel oil and pulverized coal.

Pulverized coal has certain disdvantages which limit the use thereof as fuel, such as difficulty in transportation and storage, low heat value, difficulty in combustion-control and the like. Mixtures of pulverized coal with fuel oils generally eliminate these disadvantages because they are similar to fuel oils in many respects such as fluidity while their costs per unit heat value are generally lower than fuel oils. The history of the study in this field goes back to the works by Herman Plauson in 1913, C. J. Greenstreet in 1920, J. W. Leadbeater in 1922, A. G. Balcke in 1932 and F. Uhde in 1936. In these works attempts were directed to the stabilization of the mixture of pulverized coal and fuel oils to prevent the mixture from being separated into its components due to the density differential between the coal and the fuel oil. A number of additives were tested as stabilizers including soaps, milk, gelatin, starch, albumin, gums, heavy paraffin, cyclic olefins, resinates, oleates, stearates, palmitates, creosote oil, alkalis, anthracene oil, coal tar, phenols, pyridine, aniline, naphthalene and the like. With the use of these additives at a concentration greater than 1% by weight it was impossible to obtain a satisfactory stabilization for a month or more. This insufficient stability and relatively large amounts of additives made the resulting mixture expensive and impractical.

Recently studies on the fuel slurry of this type have been revived. U.S. Pat. No. 3,615,095 discloses a gel-type pulverized coal-oil mixture wherein particles of pulverized coal are dispersed in an O/W type thixotropic emulsion of oil. The amount of emulsifier needed exceeds 1% by weight of the resultant mixture and the cost thereof makes it impractical.

Accordingly it is an object of the present invention to provide a method for stabilizing a fuel slurry comprising pulverized coal and fuel oil with a minimum amount of a stabilizing agent.

Another object of the present invention is to provide a composition comprising fuel oil and pulverized coal which is stable, namely no appreciable sedimentation of pulverized coal will take place for a long period of time.

According to the present invention, a fuel slurry composition is provided which comprises 10 to 60 weight % of pulverized coal having an average particle size of less than 200 microns, less than 50 weight % of water, the balance of a fuel oil and an effective amount of a stabilizing agent selected from the group consisting of (a) a polyether-type adduct having a molecular weight from 1,000 to 100,000 between a lower alkylene oxide and a compound having at least three active hydrogen atoms selected from the group consisting of an alcohol, an amine, a carboxylic acid and a phenol, (b) an inorganic acid ester of said polyether-type adduct, and (c) a cross-linked product of said polyether-type adduct or said inorganic acid ester with a cross-linking agent selected from the group consisting of a polyisocyanate, a polyepoxy compound, a polyaldehyde, a polycarboxylic acid and a functional derivative thereof. With the use of said stabilizing agent in an amount of 0.03 to 1.0% by weight relative to the entire composition, the resulting slurry is stable for at least 3 months at room temperature or for at least one month at 70° C. and not appreciable sedimentation of pulverized coal takes place during said period. The slurry may be pumped and burnt with conventional equipments such as water boilers or furnaces.

In practising the present invention various types of coal may be used regardless of the place of production, chemical constitution or moisture content, and include anthracite, bituminous coal, subbituminous coal, lignite and the like. The coal may be pulverized in conventional manner either in dry process or in wet process in oil using various types of mills. Pulverization of coal has long been commercial practice and, therefore, there is no need for further explanations thereon. Average particle size of the pulverized coal to be employed in the present invention is preferably less than 200 microns and the less particle size the better. Since excessive energy is required to obtain a particle size less than 10 microns, the lower limit is a matter of economy.

The content of pulverized coal in the final fuel slurry preferably ranges from 10 to 60% weight, more preferably from 20 to 55% by weight. Higher contents result in an increase in viscosity with a decrease in fluidity and lower contents are economically insignificant.

The term "fuel oils" as used herein means petroleum crude oil and liquid fractions thereof such as kerosine, light oil, heavy oils such as bunker A, bunker B and bunker C, cracked residue of ethylene; coal tar fractions such as creosote oil and anthracene oil; various waste oils such as motor oils, lubricants, machine oils, cutting oils, cleaning oils, waste oils from marines, waste oils from chemical plants and mixtures of these oils. Among them petroleum crude oil, bunker A, bunker B and bunker C are mose preferable because they may be easily available in large quantities at a relatively lower cost. In cases where two or more different types of oils are to be mixed, they may be mixed either prior to or subsequent to the mixing step with pulverized coal.

The fuel slurry of the present invention may contain up to 50% by weight of water relative to the entire slurry composition. This water may originate from the coal or be added to the composition. Higher water contents cause increase in transportation costs and decrease in heat value, and are, therefore, not desirable. However, water may improve the stability of the resulting slurry and cleanness of flue gas in terms of decrease in dust and $NO_x$. Therefore, a water content of less than 7% by weight is normally preferred.

The stabilizing agents which may be employed in the present invention include polyether-type adducts of the formula:

$$Z[(RO)nH]m$$

wherein Z is the residue of an alcohol, an amine, a carboxylic acid or a phenol with removal of the active hydrogen atoms, RO is a lower alkyleneoxy group, n is the degree of polymerization, and m is an integer of at least 3. The molecular weight thereof ranges from 1,000 to 100,000. They may be prepared by reacting the starting alcohol, amine, carboxylic acid or phenol having at least three active hydrogen atoms with a lower alkylene oxide at an elevated pressure in the presence of an acid or alkali catalyst. Examples of said alkylene oxide include ethylene oxide, propylene oxide and butylene oxide. Ethylene chlorohydrin and ethylene carbonate may also be employed for the production of the adduct. The $(RO)_n$ chain in the adduct may be that of a random or block copolymer between different alkylene oxides. Examples of alcohols to be employed include those having three active hydrogen atoms such as glycerin, butanetriol, hexanetriol, trimethylolpropane or triethanolamine, those having four active hydrogen atoms such as diglycerin or pentaerythritol, and those having five or more active hydrogen such as sorbitol, glucose, sucrose, polyvinyl alcohol or partly saponified polyvinylacetate.

Examples of amines to be employed include those having three active hydrogen atoms such as ammonia or tallow propylenediamine, those having four active hydrogen atoms such as ethylene-diamine, tetramethylenediamine or cyclohexyldiamine, and those having five or more active hydrogen atoms such as diethylenetriamine, triethylenetetramine or tetraethylenepentamine.

Examples of carboxylic acids to be employed include those having at least three active hydrogen atoms such as ethylenediaminetetraacetic acid, homopolymers and copolymers of methacrylic acid, homopolymers and copolymers of acrylic acid or homopolymers and copolymers of maleic anhydride.

Examples of phenols to be exployed include phenol-formaldehyde-, alkylphenol-formaldehyde- and naphthol-formaldehyde condensates having at least three active hydrogen atoms.

Those compounds having different functional groups of the above-mentioned type in the molecule may also be used as the starting compound provided they have at least three active hydrogen atoms. Examples of such compounds are glycine, malic acid, monoethanolamine, diethanolamine, aminoethyl-ethanolamine, tartaric acid and the like.

More preferably the starting compound has at least five active hydrogen atoms.

The molar ratio of alkylene oxide to the starting compound is preferably adjusted so that the resulting adduct has an average molecular weight from 1,000 to 100,000, more preferably from 7,000 to 100,000. The average molecular weight may be easily determined by measuring the hydroxyl number of the adduct.

Inorganic acid esters of the above-mentioned adducts, such as phosphoric acid esters or salts thereof, or sulfuric acid esters or salts thereof may be used in the slurry composition of the present invention.

The polyether-type adducts or the inorganic acid esters of the above-described type may be cross-linked with a cross-linking agent to produce a stabilizing agent for use in the fuel slurry composition of the present invention. Examples of suitable cross-linking agents are polyisocyanates such as hexamethylenediisocyanate, tolylenediisocyanate, metaxylenediisocyanate, 4,4'-diphenylmethanediisocyanate or 1,5-naphthylenediisocyanate, polyepoxy compounds such as diglycidylbisphenol A, diglycidylethyleneglycol or diglycidyltetraoxyethyleneglycol, polyaldehydes such as glyoxal or thiodiacetaldehyde, polycarboxylic acids such as oxalic acid, phthalic acid, maleic acid, adipic acid, dimer acid, butanetetracarboxylic acid, ethylenediaminetetraacetic acid, homopolymers and copolymers of acrylic acid or homopolymers and copolymers of methacrylic acid, and acid halides of said polycarboxylic acids. The cross-linking reaction may be easily carried out by mixing said polyether-type adduct or inorganic acid ester thereof with said cross-linking agent preferably with heating. The ratio of the cross-linking agent to said polyether-type adduct or said ester thereof may vary over a wide range but preferably is from 0.05 to 5 equivalents, more preferably from 0.1 to 3 equivalents per one equivalent of the terminal free hydroxy groups of the polyether-type adduct or its ester.

The above stabilizing agent may be used in conjunction with other anionic surfactants or nonionic surfactants. In this case the above stabilizing agent must be present in amounts of at least 20%, preferably 40% by weight of the mixture, i.e. based on the total weight of the above stabilizing agent plus additional surfactants.

Usually addition of 0.03% to 0.5% weight of the above stabilizing agent is sufficient to effectively stabilize the fuel slurry, though higher percents, for example up to 1%, may be employed. The stabilizing agent may be added to oil and/or water and then the mixture is mixed with pulverized coal, although the components of the fuel slurry of the present invention may be mixed in any desired order. The mixing is carried out using a conventional equipment to effect thorough mixing of the fuel slurry.

Although the reason why the stabilizing agent used in the present invention exhibits an excellent result cannot be fully explained yet, it is postulated as follows.

The stabilizing agents may be easily adsorbed on the hydrophilic surface of pulverized coal when they are mixed with the pulverized coal in the fuel slurry. Once the stabilizing agents have been adsorbed on the surface of particles of pulverized coal, the repulsive force of the molecular chain or ionic repulsive effect prevents agglomeration of individual particles and then sedimentation of the pulverized coal is minimized. Since the stabilizing agent has at least three polyoxyalkylene chains in the molecule and a molecular weight as high as from 1,000 to 100,000, preferably from 7,000 to 100,000, its molecule occupies a bulky, steric configuration. This peculiar molecular configuration also contribute to the excellent stabilizing effect thereof. The fuel slurry according to the present invention is stable for at least 3 months at room temperature or for at least one month at 70° C. on storage without causing sedimentation of pulverized coal in any appreciable amount. The fuel slurry may be burnt in conventional equipments in a similar manner to burning of oils.

The fuel slurry of the present invention may further contain, if desired, an amount of pulverized carbonized solid fuel other than pulverized coal such as coke or charcoal.

The fuel slurry and the preparation thereof according to the present invention are more fully illustrated by the following examples. These examples are included here for the purpose of illustration only and are not intended as a limitation. All percents therein are by weight.

EXAMPLE 1

Australian bituminous coal was pulverized in a mill to an average particle size of 70 microns. As a fuel oil bunker C was used. As a stabilizing agent one of the following compounds was used respectively:

(i) Triethanolamine-propylene oxide adduct (average M.W. = 7,000).

(ii) Polyglycerin-propylene oxide adduct (average M.W. = 10,000).

(iii) Sorbitol-propylene oxide-ethylene oxide adduct (average M.W. = 20,000)

(iv) Sucrose-propylene oxide-ethylene oxide adduct (average M.W. = 10,000)

To a 5 $m^3$ capacity iron tank having a spiral mixing blade and a steam jacket were charged 1500 kg of bunker C oil, which had been preheated to 100° C., 1500 kg of the pulverized coal having a moisture content of 3% and 3 kg of one of the above stabilizing agent. The mixture was stirred at 300 r.p.m. for 20 minutes at 70° C. to give the desired fuel slurry.

A quantity of each resulting fuel slurry was allowed to stand for 3 months at room temperature or for one month at 70° C. in a cylinder of 10 cm diameter × 100 cm hight and samples were taken from the upper layer and the lower layer respectively. Measurement of the concentration of pulverized coal and the density of the slurry showed that the difference in the concentration and the density between the upper layer and the lower layer was less than 3% in each case. The resultant fuel slurry had a viscosity of about 1000 cPs at 70° C., and was easily pumped and burnt in conventional boilers and furnaces.

EXAMPLE 2

Indonesian subbituminous coal was pulverized in crude petroleum oil in a ball mill and dehydrated by heating to give a mixture containing 40% of pulverized coal of an average particle size of 40 microns and 2% of water (originating from the coal). To the flow of the mixture was continuously added one of the following stabilizing agents through a metering pump so that the final concentration thereof was 0.2%, and the mixture was stirred by a turbine mixer installed in the flow line at 3,000 r.p.m.

(i) Ammonia-propylene oxide-ethylene oxide adduct (average M.W. = 7,500).

(ii) Diethylenetriamine-propylene oxide-ethylene oxide adduct (average M.W. = 20,000).

(iii) Tetraethylenepentamine-propylene oxide-ethylene oxide adduct.

The resulting fuel slurry showed good pumping and burning properties and no appreciable sedimentation of coal particles took place on storage for 3 months at room temperature or for one month at 70° C. After one month storage, the stability of the slurry was not impaired upon re-mixing, shaking or thermal shocking.

EXAMPLE 3

The process of Example 1 was repeated except that Australian anthracite was replaced for Australian bituminous coal and one of the following stabilizing agents was used.

(i) Styrene-maleic anhydride copolymer-propylene oxide-ethylene oxide adduct (averabe M.W. = 50,000).

(ii) Polyacrylic acid-ethylene oxide adduct (average M.W. = 30,000).

(iii) Phenol-formaldehyde condensate (seven nuclei)-propylene oxide-ethylene oxide adduct (average M.W. = 9,000).

(iv) alkylphenol-formaldehyde condensate (five nuclei)-propylene oxide-ethylene oxide adduct (average M.W. = 15,000).

The resulting fuel slurry showed improved stability, pumping and burning properties as the product of Example 1.

EXAMPLE 4

The process of Example 2 was repeated except that Japanese bituminous coal was replaced for Indonesian subbituminous coal and one of the following stabilizing agents was used.

(i) Polyglycerin-propylene oxide adduct sulfate.

(ii) Ammonium salt of sorbitol-propylene oxide-ethylene oxide adduct phosphate.

The coal was pulverized so that 60% thereof passed through 200 mesh screen and the concentration thereof was 35%.

The resulting fuel slurry showed improved stability, pumping and burning properties as the product of Example 2.

EXAMPLE 5

The process of Example 2 was repeated except that South African bituminous coal was replaced for Indonesian subbituminous coal and one of the following stabilizing agents was used at a final concentration of 0.1%.

(i) Diethylenetriamine-propylene oxide-ethylene oxide adduct cross-linked with diglycidylethyleneglycol.

(ii) Sorbitol-propylene oxide-ethylene oxide-adduct cross-linked with tolylenediisocyanate.

(iii) Trimethylolpropane-propylene oxide-ethylene oxide adduct cross-linked with glyoxal.

(iv) Sorbitol-propylene oxide-ethylene oxide adduct cross-linked with adipic acid.

The coal was pulverized so that 80% thereof passed through 200 mesh screen and the concentration thereof was 50%.

The resulting fuel slurry in each case was superior to that of Example 2 in the stability, and the pumping and burning properties.

It is to be understood that the foregoing detailed description is given merely by way of illustration and that many variations may be made therein without departing from the spirit of the present invention.

What is claimed is:

1. A fuel slurry composition comprising a fuel oil, 10 to 60 weight % of pulverized coal having an average particle size of less than 200 microns, less than 50 weight % of water and an effective amount of a stabilizing agent selected from the group consisting of:

(a) a polyether-type adduct havng a molecular weight from 1,000 to 100,000 between a lower alkylene oxide and a compound having at least three active hydrogen atoms selected from the group consisting of an alcohol, an amine, a carboxylic acid and a phenol, (b) an inorganic acid ester of said polyether-type adduct, and (c) a cross-linked product of said polyether-type adduct or said inorganic acid ester with a cross-linking agent selected from the group consisting of a polyisocyanate, a polyepoxy compound, a polyaldehyde, a polycarboxylic acid and a functional derivative of said polycarboxylic acid, said effective amount of said stabilizing agent minimizing sedimentation of said pulverized coal from said composition.

2. The composition of claim 1, wherein said fuel oil is petroleum/crude oil or a liquid fraction thereof.

3. The composition of claim 1, wherein said coal is anthracite, bituminous coal, subbituminous coal or lignite.

4. The composition of claim 1, wherein said pulverized coal is produced by dry process or wet process in said fuel oil.

5. The composition of claim 1 containing less than 7 weight % of water.

6. The composition of claim 1, wherein said compound has at least five active hydrogen atoms.

7. The composition of claim 1, wherein said alcohol is glycerin, butanetriol, hexanetriol, trimethylolpropane, triethanolamine, diglycerin, pentaerythritol, sorbitol, glucose, sucrose or polyvinylalcohol.

8. The composition of claim 1, wherein said amine is ammonia, tallow propylenediamine, ethylenediamine, tetramethylenediamine, cyclohexyldiamine, diethylenetriamine, trimethylenetetramine or tetramethylenepentamine.

9. The composition of claim 1, wherein said carboxylic acid is ethylenediaminetetraacetic acid, homopolymers and copolymers of acrylic acid, homopolymers or copolymers of methacrylic acid, or homopolymers and copolymers of maleic anhydride.

10. The composition of claim 1, wherein said phenol is phenol-formaldehyde condensate, alkylphenol-formaldehyde condensate or naphthol-formaldehyde condensate.

11. The composition of claim 1, wherein said alkylene oxide is ethylene oxide, propylene oxide or mixtures thereof.

12. The composition of claim 1, wherein said polyether-type adduct has a molecular weight from 7,000 to 100,000.

13. The composition of claim 1, wherein said inorganic acid ester is sulfate or phosphate.

14. The composition of claim 1, wherein said polyisocyanate is hexamethylenediisocyanate, tolylenediisocyanate or metaxylenediisocyanate.

15. The composition of claim 1, wherein said polyepoxy compound is diglycidylbisphenol A, diglycidylethyleneglycol or diglycidyl-tetraoxyethyleneglycol.

16. The composition of claim 1, wherein said polyaldehyde is glyoxal or thiodiacetaldehyde.

17. The composition of claim 1, wherein said polycarboxylic acid is oxalic acid, phthalic acid, maleic acid, adipic acid, dimer acid, butanetetracarboxylic acid, ethylenediamine-tetraacetic acid, homopolymers and copolymers of acrylic acid, or homopolymers and copolymers of methacrylic acid.

18. The composition of claim 1, wherein said functional derivative is acid halide.

* * * * *